US005715882A

United States Patent [19]

Suehiro

[11] Patent Number: 5,715,882

[45] Date of Patent: Feb. 10, 1998

[54] WIRING HARNESS ASSEMBLING BOARD

[75] Inventor: Shinichi Suehiro, Yokkaichi, Japan

[73] Assignee: Sumitomo Wiring Systems, Ltd., Japan

[21] Appl. No.: 745,069

[22] Filed: Nov. 7, 1996

[30] Foreign Application Priority Data

Nov. 8, 1995 [JP] Japan ..... 7-289802

[51] Int. Cl.[6] ..... B21F 27/12

[52] U.S. Cl. ..... 140/92.1; 29/720

[58] Field of Search ..... 140/92.1; 29/720, 29/755

[56] References Cited

U.S. PATENT DOCUMENTS

| | | | |
|---|---|---|---|
| 4,102,568 | 7/1978 | Miyagi | 29/720 |
| 4,711,025 | 12/1987 | DeSanto | 29/755 |
| 5,522,436 | 6/1996 | Tabuchi et al. | 140/92.1 |

FOREIGN PATENT DOCUMENTS

| | | |
|---|---|---|
| 1221641 | 2/1971 | United Kingdom . |
| 2246087 | 1/1992 | United Kingdom . |

*Primary Examiner*—Lowell A. Larson
*Attorney, Agent, or Firm*—Anthony J. Casella; Gerald E. Hespos; Ludomir A. Budzyn

[57] ABSTRACT

To enable inspection of a taped state at a junction portion of a wiring harness without lifting the wiring harness at a wiring harness assembling board used for the manufacturing of an automotive wiring harness. A wiring harness assembling board is provided with a board main body 1*a* and a plurality of wire retainers 3 which include a shaft and a wire retaining portion 3*b* at the leading end of the shaft and stand in specified positions of the board main body 1*a*. A flat mirror member 11 for reflecting the rear side of a wiring harness W/H is disposed in the vicinity of at least one wire retainer 3 corresponding to a junction portion of the wiring harness W/H.

10 Claims, 7 Drawing Sheets

WIRING HARNESS ASSEMBLING BOARD

BACKGROUND OF THE INVENTION

1. Field of the Invention

The present invention relates to a wiring harness assembling board used for the manufacturing of an automotive wiring harness and, particularly to an assembling board which enables the inspection of taping at junction portions of a wiring harness without lifting the wiring harness therefrom.

2. Description of the Prior Art

A wiring harness formed by binding a multitude of wires has been used to arrange electrical devices of an automotive vehicle. A wiring harness assembling board 1 as shown in FIG. 10 is used to manufacture a wiring harness W/H.

The assembling board 1 is such that a board main body comprised of a rectangular plate having desired width and height (for example, width=about 180 cm and height=90 cm) is placed on a mount 1*b*, preferably inclined forward toward an operator 2 at a specified angle.

Elevating wire retainers 3 as shown in FIG. 3 stand in specified positions of the board main body 1*a*. Each wire retainer 3 includes a base 3*a*, a two- or three-forked or plurally forked wire retaining portion 3*b*, and an elevating shaft 3*c*. The wire retaining portion 3*b* is provided at the leading end of the elevating shaft 3*c*. Through holes (not shown) are formed in positions of the assembling board 1 where the wire retainers 3 are mounted. Each elevating shaft 3*c* is easily settable to a projecting position where the wire retaining portion 3*b* is distanced from and above the board main body 1*a* as shown by solid line in FIG. 11 and to a retracted position where the wire retaining portion 3*b* is lowered to the base 3*a* as shown by dotted line in FIG. 11. No detailed description is given on the specific structure of the wire retainer 3 since it is known. When the wiring harness W/H is manufactured, the elevating shafts 3*c* of the respective wire retainers 3 are first set in their projecting positions, and wires 5 used for the construction of the wiring harness W/H are arranged at the wire retaining portions 3*b*. Subsequently, adhesive tape 6 is wound around the arranged wires 5 to bundle them. At this time, when the adhesive tape 6 comes to a portion of the wiring harness corresponding to the position of the wire retainer 3, the elevating shaft 3*c* is set in its retracted position, thereby avoiding interference of the adhesive tape 6 with the wire retainer 3.

After the completion of taping, an inspection is made as to whether the adhesive tape 6 is completely wound at the junction portions of the wiring harness W/H, i.e. whether there are positions where the wires 5 can be seen between two adjacent winds of the tape 6.

With the prior art wiring harness assembling board 1, the above inspection makes it necessary to, after moving the wire retaining portion 3*b* of the wire retainer 3 to its retracted position, lift the wiring harness W/H and to see the side (rear side) of the wiring harness W/H opposite from the operator 2. This leads to an increase in the number of operation steps. Further, it is cumbersome to lift the wiring harness W/H. More specifically, in a junction portion A near an end of the wiring harness W/H, the wiring harness W/H can easily be lifted only by lifting the junction portion A to see the taping on the rear side. However, in a junction portion B near the middle of the wiring harness W/H, the wiring harness W/H cannot be lifted only by lifting the junction portion B, making it necessary to lift the wiring harness W/H in neighboring junction portions C, D. Since the total weight of the wiring harness W/H is not light, it is very cumbersome and tiring to frequently lift the wiring harness W/H.

The present invention was developed to solve the problems associated with the prior art wiring harness assembling board, and an object thereof is to facilitate the confirmation as to how an adhesive tape is wound.

SUMMARY OF THE INVENTION

According to the invention the number of steps necessary for the confirmation as to how an adhesive tape is wound around the wires is reduced thus facilitating the confirmation.

According to the invention there is provided a wiring harness assembling board, comprising: a board main body, at least one wire retainer being arranged at a predetermined or predeterminable position on the board main body, and at least one mirror member capable of reflecting at least partly a portion, in particular a rear side of a wiring harness arrangeable on or at the wire retainer.

According to a preferred embodiment the at least one mirror member is disposed or disposable or arrangeable in the vicinity of the wire retainer, in particular corresponding to a junction portion of the wiring harness.

Preferably, the one or more wire retainers include a shaft and a wire retaining portion being in particular forked or U-shaped at a leading end of the shaft.

The mirror member comprises at least one substantially planar mirror portion.

Further preferably, the mirror member has a substantially curved, particularly concave and/or convex mirror surface or portion, wherein the substantially curved mirror portion has particularly a predetermined or predeterminable magnification factor or magnification factor range.

Thus the operator has the possibility to inspect the winding of the tape and the connection of the forked or branched off wire with an enhanced accuracy or degree of precision.

According to a further preferred embodiment of the invention, the wiring harness assembling board further comprises angle or orientation adjusting means (e.g. a ball joint mechanism) for adjusting or varying an angle or orientation of the mirror member with respect to the board main body.

Thus the operation and orientation of the mirror member is facilitated, allowing in particular an adaptation to different operators having e.g. different heights.

Preferably, the mirror member comprises at least two members being pivotally connected with one another, wherein an orientation or an angle of inclination between the members is adjustable.

Further preferably, the mirror member comprises first, second and third members being in particular substantially flat, the second and third members being pivotally connected with one and the other sides of the first member, respectively, and wherein orientation or angles of inclination of the second and third members with respect to the first member are adjustable, in particular independently from each other.

Most preferably, the members are pivotally connected with one another by means of at least one hinge.

According to a further preferred embodiment of the invention, the mirror member is at least partly, elastically and/or plastically deformable.

Preferably, the wiring harness assembling board further comprises suspension or supporting means for displaceably or movably supporting or suspending the mirror member, wherein the mirror member is displaceable in one, two or three dimensions.

Thus an operator can easily adapt the orientation and/or placement of the mirror to a new working condition e.g. after a shift change or the like.

According to a preferred embodiment of the invention there is provided a wiring harness assembling board, comprising:

a board main body, and a plurality of wire retainers which include a shaft and a forked or U-shaped wire retaining portion at the leading end of the shaft and stand in specified or predetermined or predeterminable positions of the board main body, wherein a mirror member for reflecting at least partly the rear side of a wiring harness is disposed in the vicinity of at least one wire retainer corresponding to a junction portion of the wiring harness.

When a wiring harness is manufactured using the above wiring harness assembling board, the rear side of at least part of the wiring harness is reflected on the mirror member disposed in the vicinity of at least one wire retainer corresponding to the junction portion of the wiring harness. How an adhesive tape is wound around the wiring harness can be confirmed on the basis of the reflection of the mirror member. Accordingly, it is not necessary to lift the wiring harness, which in turn reduces the number of operation steps. Further, since the taped state can be easily confirmed only by seeing the reflection on the mirror surface of the mirror member as described above, a working time can be shortened.

The mirror member is preferably in the form of a flat plate.

If the mirror member is in the form of a flat plate, angle adjusting means for adjusting an angle of the mirror member with respect to the board main body may preferably be provided.

Accordingly, the angle of inclination of the mirror member can be suitably adjusted such that an operator can securely see the reflection of at least part of the rear side of the wiring harness on the mirror member.

The mirror member may have a curved or convex mirror surface.

The mirror member preferably comprises flat first, second and third members, the second and third members being pivotally connected with one and the other sides of the first member, respectively, and angles of inclination of the second and third members with respect to the first member are preferably adjustable.

By constructing the mirror member as above, the operator can securely see the reflection of the rear side of the wiring harness on the mirror member even if the position of his eyes slightly changes.

These and other objects, features and advantages of the present invention will become more apparent upon a reading of the following detailed description and accompanying drawings.

DETAILED DESCRIPTION OF THE PREFERRED EMBODIMENT

Figure 10:
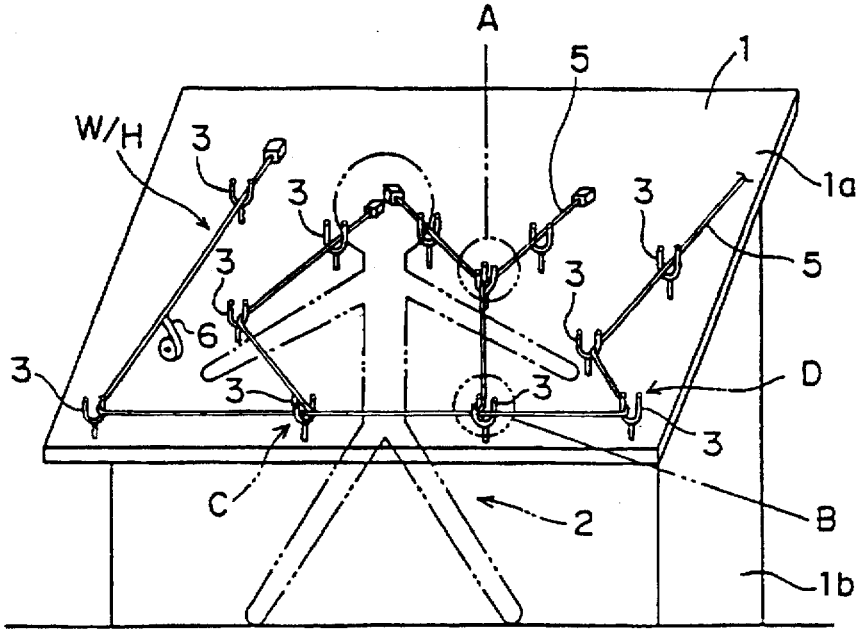
FIG. 10 PRIOR ART
FIG. 10 is a perspective view of an entire prior art wiring harness assembling board.
Figure 11:
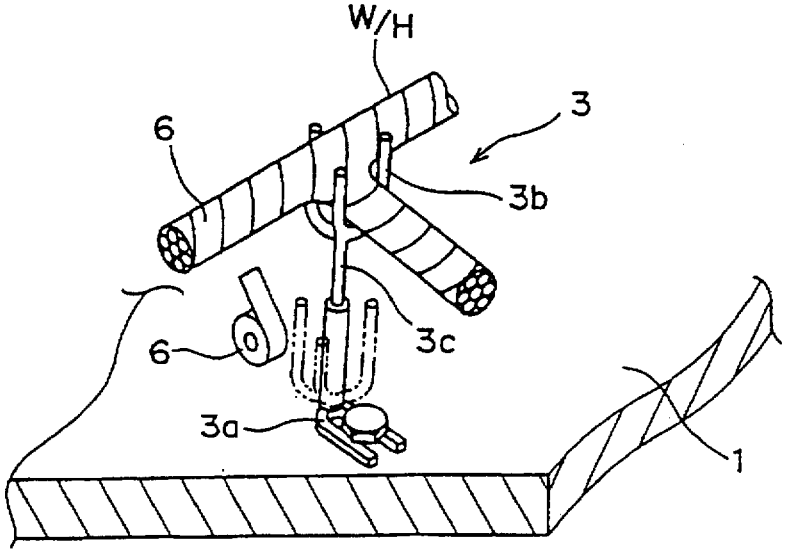
FIG. 11 PRIOR ART
FIG. 11 is a perspective view of an essential portion showing an elevating wire retainer.

Illustrated embodiments of the invention are described in detail. The same elements as those of the prior art wiring harness assembling board shown in FIGS. 10 and 11 are identified by the same reference numbers, and no detailed description is given thereon.

Figure 1:
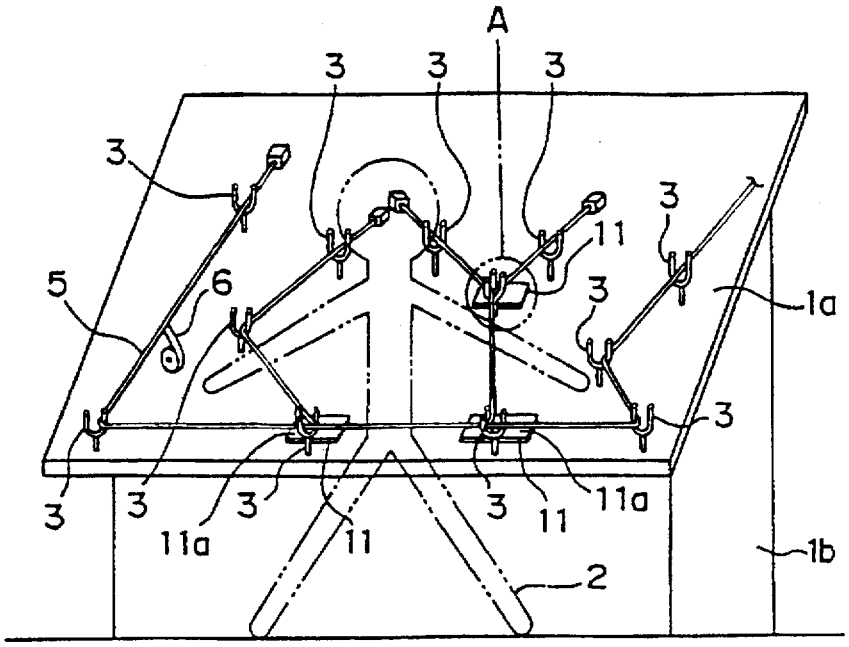
FIG. 1 is a perspective view of an entire wiring harness assembling board according to a first embodiment of the invention.
Figure 2:
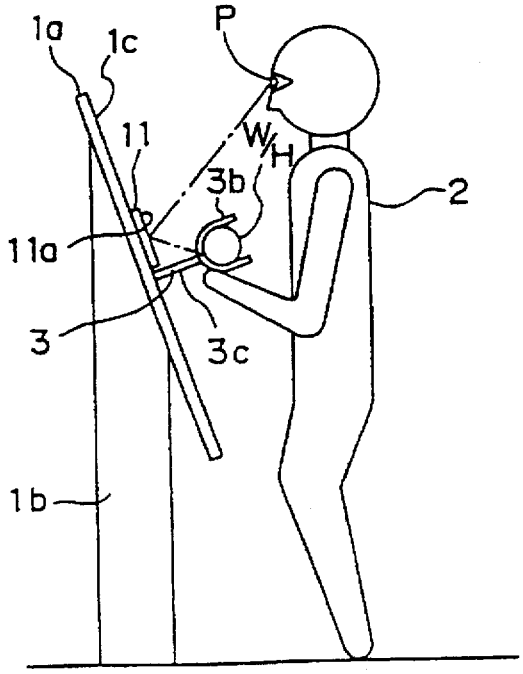
FIG. 2 is a side view of the wiring harness assembling board according to the first embodiment.
Figure 3:
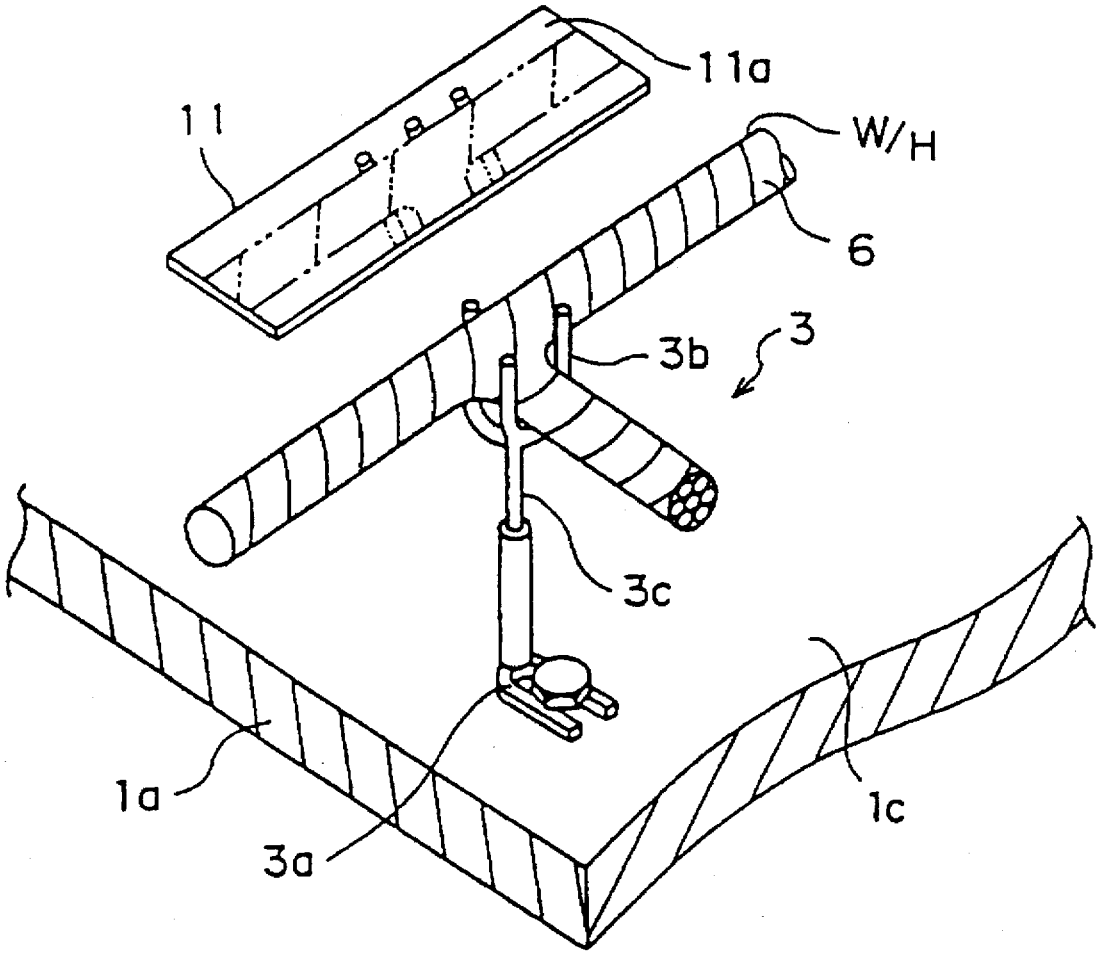
FIG. 3 is a perspective view of an essential portion of the wiring harness assembling board according to the first embodiment.

FIGS. 1 to 3 show a first embodiment of the invention.

Mirror members 11 are disposed in the vicinity of junction portions A, B, C of a wiring harness W/H on a board main body 1*a*. Each mirror member 11 has a mirror surface on at least one surface and is, as a whole, in the form of a particularly rectangular flat plate. Further, the mirror members 11 are secured in the vicinity of particularly elevating wire retainers, wire holding devices or wire holding jigs 3 used to define the junction portions A, B, C with the opposite surfaces of the mirror surfaces adhered to an upper surface 1*c* of the board main body 1*a*. The elevating wire retainers 3 may be secured to the board main body 1*a* by means of through holes (not shown). However, alternatively, magnetic securing means may be provided on an end of the elevating wire retainers 3, wherein the magnetic securing means adhere on a main board body 1*a* made out of a metal or alloy.

The dimensions and the mount positions of the mirror members 11 in the form of the rectangular flat plates as described above are set such that, when an operator 2 stands in front of the board main body 1*a*, he can see the reflection of at least one part or portion of the rear sides of the wiring harness W/H in the junction portions A, B, C on the mirror surfaces 11*a* as shown by phantom line in FIG. 2.

With the wiring harness assembling board 1 of the first embodiment, at least one part of the rear side of the wiring harness W/H in the junction portion A, B or C is reflected on the mirror surface 11*a* of the mirror member 11 as shown in FIG. 3. Accordingly, the operator 2 can confirm how an adhesive tape 6 is wound at the rear side of the junction portion on the basis of the reflection on the mirror surface 11*a*. Thus, according to the first embodiment, it is not necessary to lift the wiring harness W/H to confirm the taped state, thereby reducing the number of operation steps. Further, since the taped state in the junction portions A, B, C can be confirmed only by seeing the reflections on the mirror surfaces 11*a* of the mirror members 11 as described above, a time required for the inspection can be shortened.

Although the mirror member 11 is in the form of a rectangular flat plate in the first embodiment, it may be a flat plate having a triangular, circular, elliptical or any suitable shape provided that the operator 2 can see the reflection of the rear side of the wiring harness W/H in the junction portions A, B, C on the mirror member 11 as described above.

Figure 4:
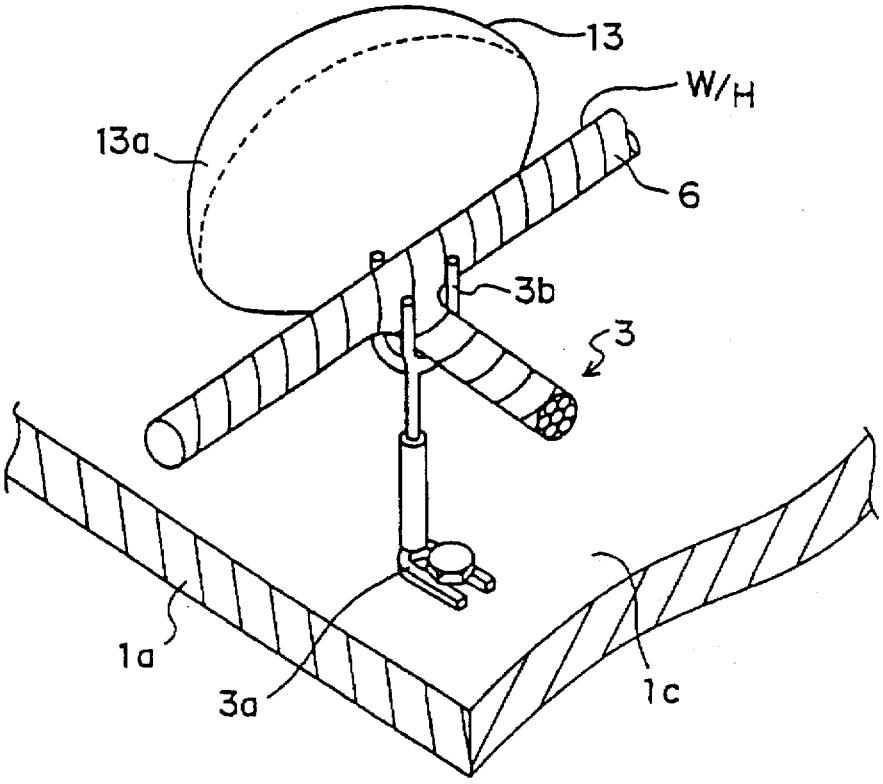
FIG. 4 is a perspective view of an essential portion of a wiring harness assembling board according to a second embodiment of the invention.

FIG. 4 shows a second embodiment of the invention.

In this embodiment, mirrors 13 having a curved or non-planar surface, in particular a substantially semielliptical shape are disposed substantially in the vicinity of the junction portions A, B, C of the wiring harness W/H. Each mirror member 13 has a mirror surface 13*a* formed particularly on the entire substantially outer semielliptical surface, and is securely adhered to the board main body 1*a* in the vicinity of the wire retainer 3 which defines the junction portion A, B or C.

In the second embodiment, similar to the first embodiment, the taped state on the rear sides of the junction portions can be confirmed on the basis of the reflections on the mirror surfaces 13*a* of the mirror members 13 and, hence, it is not necessary to lift the wiring harness W/H.

Since the mirror surface 13*a* of the mirror member 13 is a convex surface in the second embodiment, the operator 2 can securely see the reflection of the rear side of the wiring harness W/H on the mirror surface 13*a* even if a position P (see FIG. 2) of the operator's eyes slightly changes or changes within a predetermined or predeterminable range.

Figure 5:
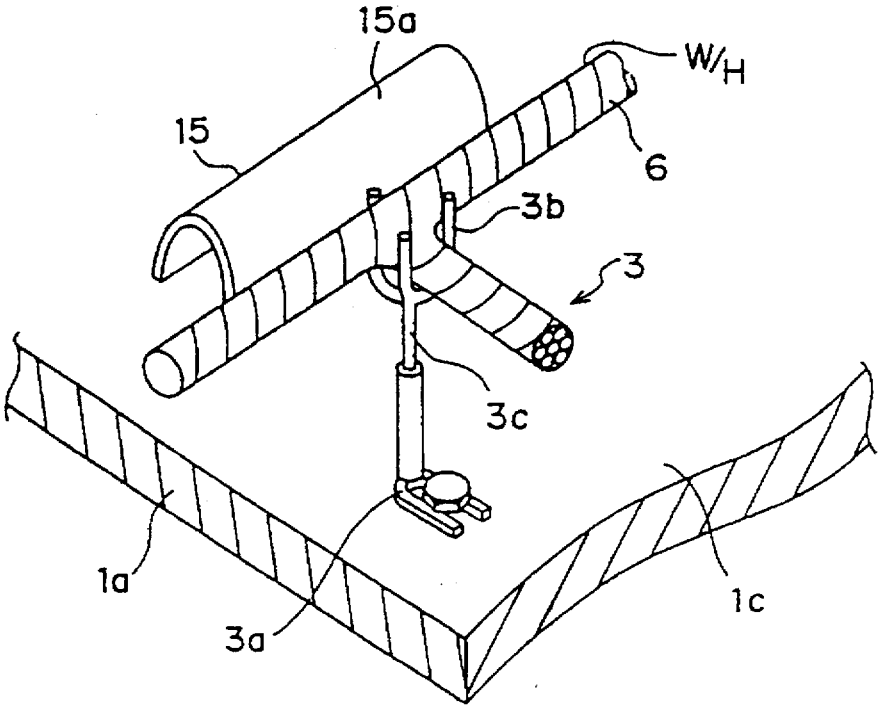
FIG. 5 is a perspective view of an essential portion of the wiring harness assembling board according to the second embodiment.

Although the mirror member 13 is semielliptical in the second embodiment, there may be provided, for example, a mirror member 15 having a substantially semicylindrical shape as shown in FIG. 5. In this case, a mirror surface 15*a* is formed on the outer wall of the mirror member 15. It should be noted that the mirror member may have any other suitable curved or convex and/or concave surface.

Figure 6:
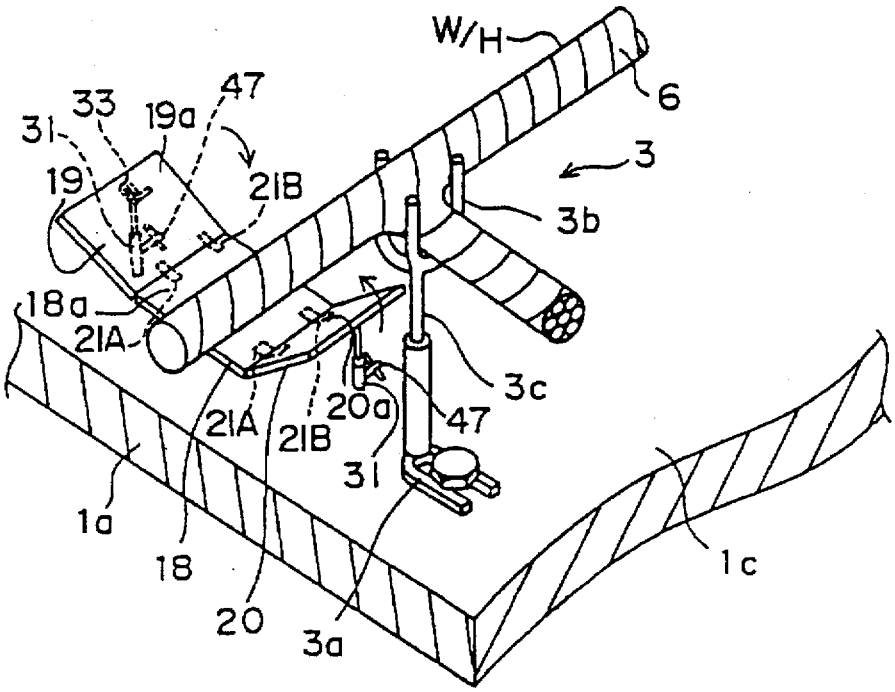
FIG. 6 is a perspective view of an essential portion of a wiring harness assembling board according to a third embodiment of the invention.

FIGS. 6 and 7 show a third embodiment of the invention.

In this embodiment, mirror members 17 disposed in the vicinity of the junctions portions A, B, C of the wiring harness W/H each include a first member 18, a second member 19 and a third member 20 which are particularly rectangular substantially flat plates. Surfaces of the first to third members 18, 19, 20 on one side are formed into mirror surfaces 18*a*, 19*a*, 20*a*.

The first member 18 has its surface opposite from the mirror surface 18*a* secured to the upper surface 1*c* of the board main body 1*a*. One side 18*b* of the first member 18 is pivotally connected with a side 19*b* of the second member 19*a* via a pair of hinges 21A, 21B. More specifically, the second member 19 is pivoted with respect to the first member 18 secured to the upper surface 1*c* of the board main body 1*a* as indicated by an arrow in FIG. 6 about the hinges 21A, 21B, thereby enabling adjustment of an angle of inclination of the second member 19 with respect to the first member 18. At the rear side of the second member 19, there is provided an elevating shaft 31 including a substantially cylindrical hollow tubular member 41 having its base end secured to the board main body 1*a*, and a coupling shaft 42 slidably or telescopically inserted into the tubular body 41 and having its leading end coupled with an oblong hole 35 formed in an L-shaped fitting mounted to the second member 19.

Figure 7A:
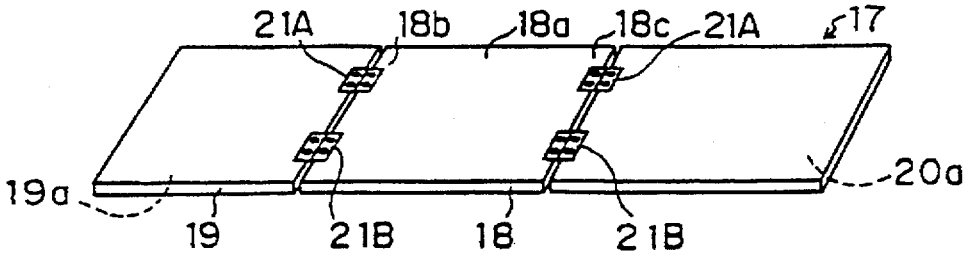
FIGS. 7A and 7B are perspective views of the mirror member according to the third embodiment when viewed from the rear side and from the mirror surface side, respectively.
Figure 7B:
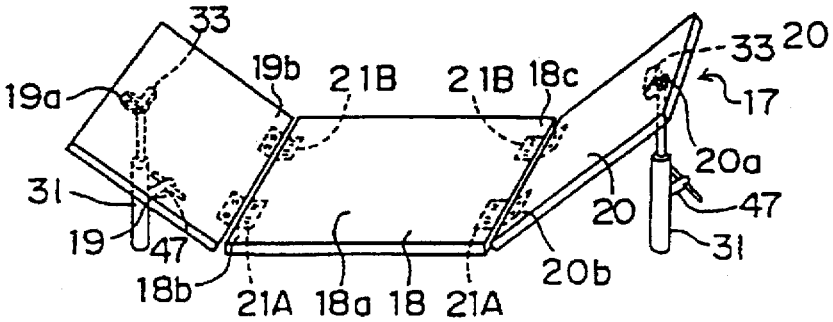

The other side 18*c* of the first member 18 is also pivotally connected with a side 20*b* of the third member 20 via further hinges 21A, 21B, thereby enabling adjustment of an angle of inclination of third member 20 with respect to the first member 18. Another elevating shaft 31 is provided at the rear side of the third member 20. Accordingly, in the third embodiment, the mirror member 17 is selectively set to a state where the mirror surfaces 18*a* to 20*a* of the first to third members 18 to 20 form a substantially flat plane as shown in FIG. 7(A) and to a state where the second and third members 19, 20 are held at specified or predetermined or predeterminable angles with respect to the first member 18, thereby forming a substantially U-shaped mirror surface as a whole as shown in FIG. 7B. Thus, in the third embodiment, the angles of inclination of the second and third members 19, 20 are suitably adjusted depending upon the position of the operator's eyes so that the operator 2 can securely see the reflection of the wiring harness W/H on any of the mirror surfaces 18*a* to 20*a* of the first to third members 18 to 20.

Figure 8:
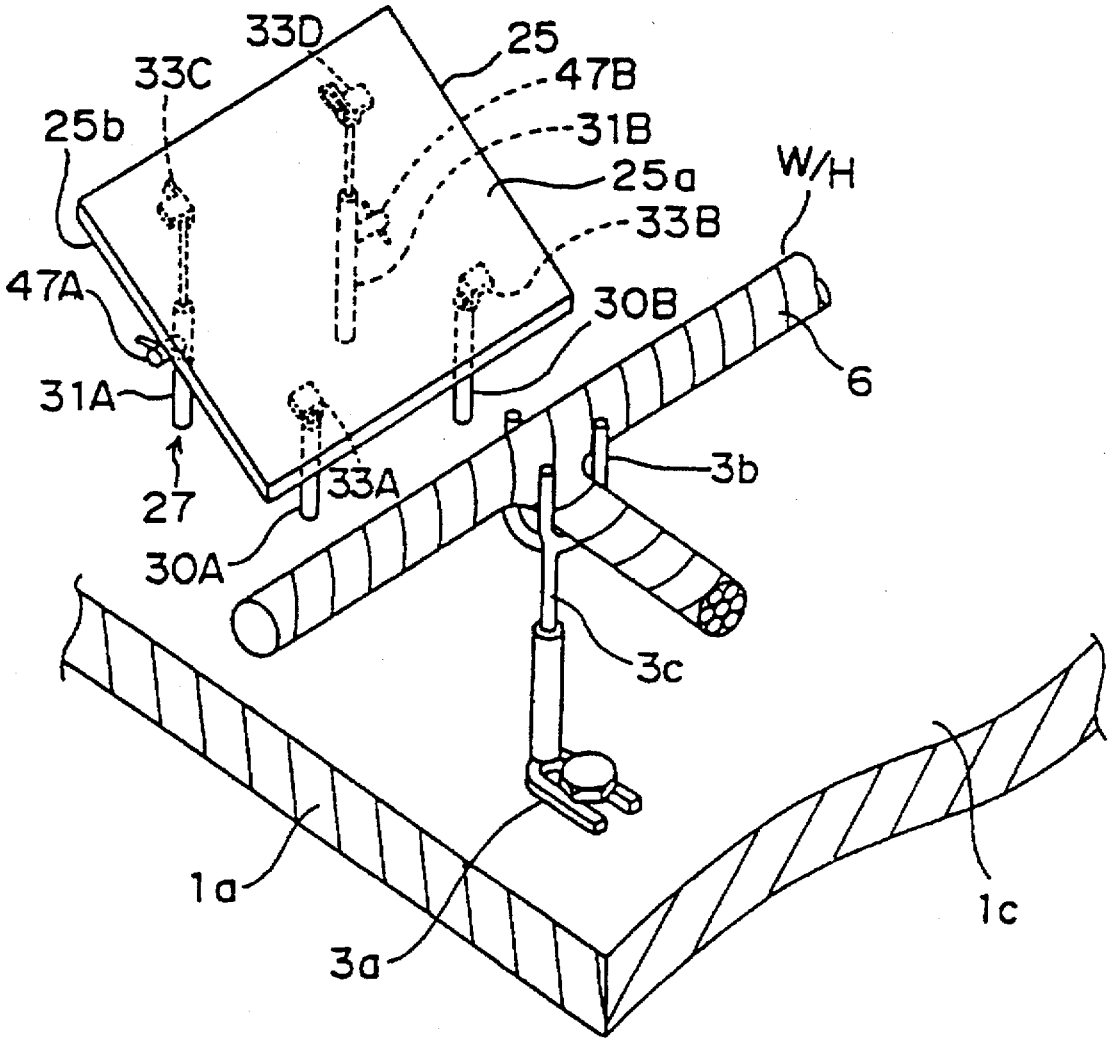
FIG. 8 is a perspective view of an essential portion of a wiring harness assembling board according to a fourth embodiment of the invention.
Figure 9:
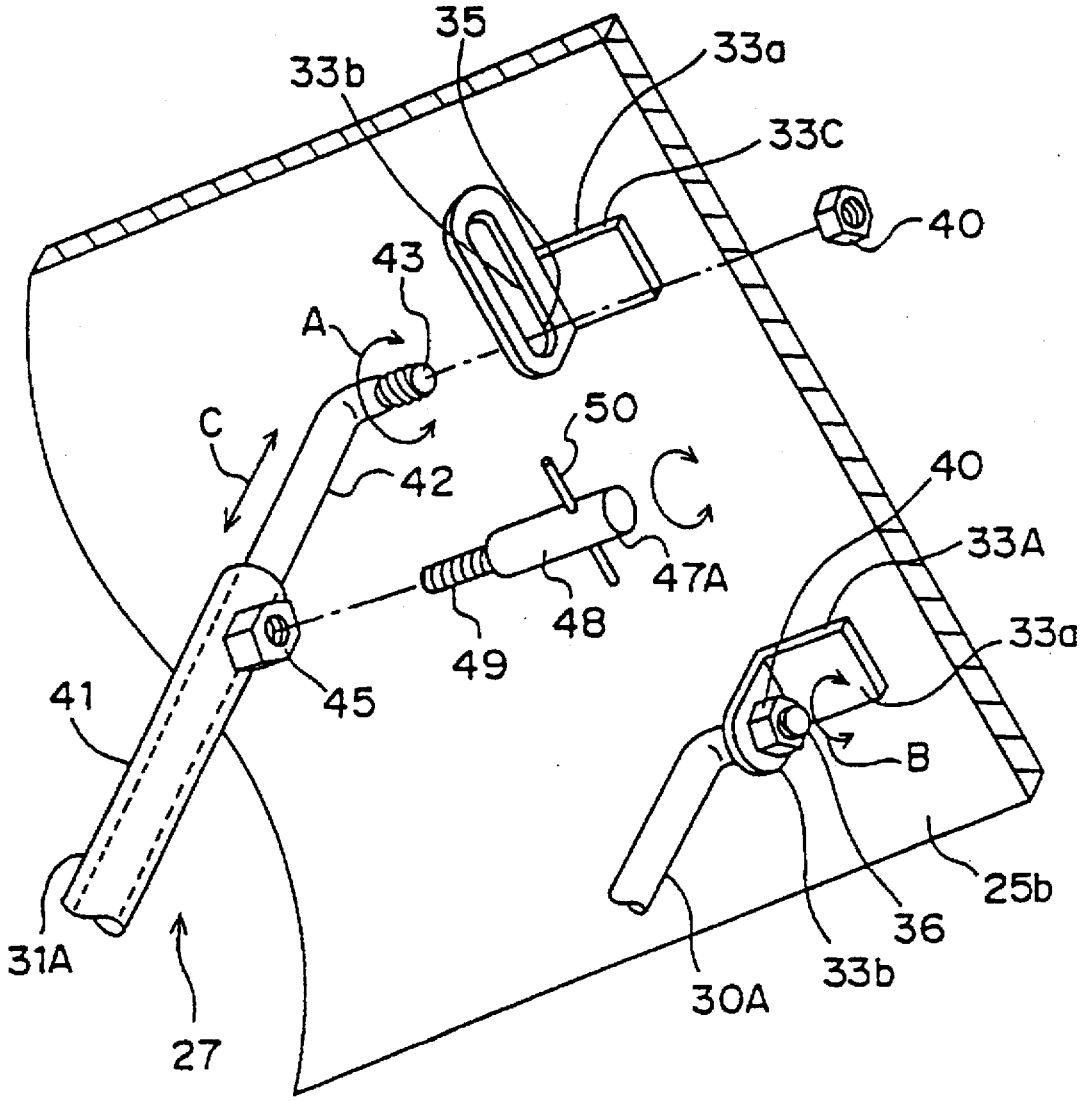
FIG. 9 is perspective view of an essential portion of a mirror member according to the fourth embodiment when viewed from the side surface.

FIGS. 8 and 9 show a fourth embodiment of the invention.

In this embodiment, similar to the first embodiment, a mirror member 25 is particularly in the form of a substantially rectangular plate, and a mirror surface 25*a* is formed on one surface of this mirror member 25. Further, in this embodiment, there is provided an angle adjusting mechanism 27 for adjusting an angle of the mirror member 25 with respect to the upper surface 1*c* of the board main body 1*a*.

The angle adjusting mechanism 27 includes a pair of pivoting shaft 30A, 30B projecting in the vicinity of the junction portion A, B or C of the wiring harness W/H and a pair of elevating shafts 31A, 31B which are juxtaposed and distanced from the pivoting shafts 30A, 30B. The mechanism 27 also includes four L-shaped fittings 33A, 33B, 33C, 33D disposed in specified positions of a rear surface 25*b* of the mirror member 25. Each of the L-shaped fittings 33A to 33D includes a fixed portion 33*a* secured to the rear surface 25*b* of the mirror member 25 and a connection portion 33*b* projecting substantially in a normal direction to the fixed portion 33*a* from the rear surface 25*b*. The connection portions 33*b* of the fittings 33A, 33B are each formed with an oblong through hole 35.

The pivoting shafts 30A, 30B have their leading ends bent substantially at right angles or substantially parallel to the rear surface 25*b* as shown in FIG. 9 while having their base ends secured to the board main body 1*a*. An external thread portion 36 is formed at each bent end of the pivoting shafts 30A, 30B. The external thread portions 36 are inserted through particularly round holes 34 formed in the fittings 33A, 33B secured to the rear surface 25*b* of the mirror member 25. Further, nuts 40 are spirally fitted to the external thread portions 36.

The elevating shafts 31A, 31B each include a substantially cylindrical hollow tubular body 41 having its end secured to the board main body 1*a* and a coupling shaft 42 slidably or telescopically inserted into the tubular body 41. The leading end of each coupling shaft 42 is bent substantially at right angles, and an external thread portion 43 is formed at this bent end. The external thread portions 43 of the respective coupling shafts 42 are inserted through the oblong holes 35 of the fittings 33C, 33D secured to the rear surface 25*b* of the mirror member 25. Further, nuts 40 are spirally fitted to the external thread portions 43.

The tubular bodies 41 of the elevating shafts 31A, 31B are each provided with an internal thread hole 45 which extends from the outer surface to the hollow portion in a direction at an angle, in particular substantially normal to the insertion direction of the coupling shaft 42. To the internal thread holes 45 are spirally fitted external thread portions 49 of fastening members 47A, 47B.

The fastening members 47A, 47B each include a cylindrical main body 48, the external thread portion 49 formed at one end of the main body 48, and a handle 50 made particularly of thin bars mounted on the other end of the main body 48 in a direction normal to the extension of the main body 48.

The angle of the mirror member 25 with respect to the board main body 1*a* is adjusted by the angle adjusting mechanism 27 as follows.

First, the nuts 40 spirally fitted to the external thread portions 36, 43 at the leading ends of the pivoting shafts 30A, 30B and the elevating shafts 31A, 31B are loosened, making the mirror member 25 pivotal about the round holes 34 and oblong holes 35 of the L-shaped fittings 33A to 33D with respect to the coupling shafts 42 of the pivoting shafts 30A, 30B and the elevating shafts 31A, 31B.

Subsequently, the handles 50 of the fastening members 47A, 47B are turned to draw the external thread portions 49 of the fastening members 47A, 47B out of the tubular bodies 41. At this time, instead of completely drawing the external thread portions 49 out, they may be retracted to the extent that the leading ends thereof are distanced from the coupling shafts 42 inserted into the tubular bodies 41. If the coupling shafts 42 are moved upward and downward in this state as indicated by an arrow C in FIG. 9, the mirror member 25 pivots about the external thread portions 36 at the leading ends of the pivoting shafts 33A, 33B, thereby adjusting the angle of inclination of the mirror member 25 with respect to the board main body 1*a*.

The angle of inclination of the mirror member 25 is fixed in the following manner. The external thread portions 49 of the fastening members 47A, 47B are spirally fitted to the internal thread portions 45 of the elevating shafts 31A, 31B to press the leading ends of the external thread portions 49 against the coupling shafts 42 within the tubular bodies 41, thereby securely positioning the coupling shafts 42. Further, the nuts 40 are spirally fitted to the external thread portions 43, 36 of the elevating shafts 31A, 31B and the pivoting shafts 30A, 30B.

In the third embodiment, the angle of inclination of the mirror member 25 with respect to the board main body can be continuously adjusted. The angle of inclination of the mirror member 25 is suitably adjusted depending upon the position of the operator's eyes so that the operator 2 can securely see the reflection of the wiring harness W/H on the mirror surface 25*a* of the mirror member 25.

In a further embodiment (not shown) the mirror member may be elastically and/or plastically deformable, such that an operator can adjust or vary the reflection characteristics of the mirror such that he can easily see at least part of the rear side of the wiring harness reflected in the mirror member. Such a mirror member may be formed e.g. by a thin metal plate being particularly supported on an elastic support such as rubber or the like. The mirror member may be supported on the board main body by a supporting means comprising one or more support members.

As is clear from the above description, with the wiring harness assembling board according to the invention, the mirror member for reflecting the rear side of the wiring harness is disposed in the vicinity of at least one wire retainer corresponding to the junction portion of the wiring harness. Accordingly, the wiring harness needs not be lifted to confirm how the adhesive tape is wound, leading to a reduced number of operation steps. Since the taped state can be confirmed only by seeing the reflection on the mirror surface of the mirror member, a time required to check the taped state can be shortened.

If the angle adjusting means for adjusting the angle of the mirror member with respect to the board main body is provided, the angle of inclination of the mirror member can be suitably adjusted or changed such that the operator can securely see the reflection of the rear side of the wiring harness on the mirror member.

If the mirror member has a curved in particular convex mirror surface or includes flat first to third members arranged such that the angles of inclination of the second and third members with respect to the first member are adjustable, the operator can securely see the reflection of the rear side of the wiring harness on the mirror member even if a position of his eyes slightly changes.

What is claimed is:

1. A wiring harness assembling board, comprising:

a board main body (1*a*), at least one wire retainer (3) being arranged at a predeterminable position on the board main body (1*a*), and at least one mirror member (11; 13; 15; 17; 25) capable of reflecting at least partly a portion of a wiring harness (W/H) arrangeable on the wire retainer (3).

2. A wiring harness assembling board according to claim 1, wherein the at least one mirror member (11; 13; 15; 17; 25) is disposable in proximity to a portion of the wire retainer (3) at a junction portion (A; B; C; D) of the wiring harness (W/H).

3. A wiring harness assembling board according to claim 2, wherein the mirror member (11; 17; 25) comprises at least one substantially planar mirror portion (11*a*; 18*a*, 19*a*, 20*a*; 25*a*).

4. A wiring harness assembling board according to claim 2, wherein the mirror member (13; 15) has a substantially curved, mirror portion (13*a*; 15*a*), with a predetermined magnification factor.

5. A wiring harness assembling board according to claim 1, further comprising orientation adjusting means (27) for adjusting an orientation of the mirror member (11; 13; 15; 17; 25) with respect to the board main body (1*a*).

6. A wiring harness assembling board according to claim 1, wherein the mirror member (17) comprises at least two members (18, 19, 20) being pivotally connected with one another, wherein the members (18, 19, 20) are adjustable relative to one another.

7. A wiring harness assembling board according to claim 6, wherein the mirror member (16) comprises first, second and third members (18, 19, 20) being substantially flat, the second and third members (19, 20) being pivotally connected with the first member (18), and wherein orientation or angles of inclination of the second and third members (19, 20) with respect to the first member (18) are adjustable independently from each other.

8. A wiring harness assembling board according to claim 7, wherein the members (18, 19, 20) are pivotally connected with one another by means of at least one hinge (21A, 21B).

9. A wiring harness assembling board according to claim 1, wherein the mirror member is at least partly deformable.

10. A wiring harness assembling board according to claim 1, further comprising suspension means (27) for displaceably supporting the mirror member (25), wherein the mirror member (25) is displaceable in a plurality of dimensions.

* * * * *